US007670458B2

(12) United States Patent
Ochi et al.

(10) Patent No.: US 7,670,458 B2
(45) Date of Patent: Mar. 2, 2010

(54) METHOD OF MANUFACTURING GRAVURE PAPER

(75) Inventors: Takashi Ochi, Tokyo (JP); Takehide Kasahara, Tokyo (JP); Hideki Fujiwara, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 377 days.

(21) Appl. No.: 11/625,199

(22) Filed: Jan. 19, 2007

(65) Prior Publication Data

US 2007/0113996 A1 May 24, 2007

Related U.S. Application Data

(63) Continuation of application No. 10/381,228, filed as application No. PCT/JP01/08234 on Sep. 21, 2001, now abandoned.

(30) Foreign Application Priority Data

Sep. 25, 2000 (JP) ..... 2000-291197
Aug. 27, 2001 (JP) ..... 2001-255554

(51) Int. Cl.
*D21H 21/22* (2006.01)

(52) U.S. Cl. ..... 162/158; 162/179; 162/206

(58) Field of Classification Search ..... 162/158, 162/164.1, 164.6, 168.2, 179, 181.1–181.2, 162/181.8, 204–207; 428/156, 206, 172, 428/195.1; 427/358, 361, 391
See application file for complete search history.

(56) References Cited

U.S. PATENT DOCUMENTS

| | | | | | |
|---|---|---|---|---|---|
| 3,400,658 | A | * | 9/1968 | Gagliardi et al. | 101/170 |
| 4,027,345 | A | * | 6/1977 | Fujisawa et al. | 8/468 |
| 4,092,283 | A | * | 5/1978 | Oishi et al. | 527/600 |
| 4,157,995 | A | | 6/1979 | Schenck et al. | |
| 4,640,714 | A | * | 2/1987 | Kagota et al. | 106/31.16 |
| 4,682,983 | A | | 7/1987 | Mehl | |
| 4,867,844 | A | | 9/1989 | Dessauer | |
| 4,908,240 | A | | 3/1990 | Auhorn et al. | |
| 5,120,365 | A | | 6/1992 | Kogler | |
| 5,302,249 | A | * | 4/1994 | Malhotra et al. | 162/135 |
| 5,401,562 | A | * | 3/1995 | Akao | 428/211.1 |
| 5,420,190 | A | | 5/1995 | Gane | |
| 5,439,872 | A | * | 8/1995 | Ito et al. | 503/227 |
| 5,500,191 | A | | 3/1996 | DeMatte | |
| 5,703,157 | A | | 12/1997 | Fujiwara et al. | |
| 5,716,692 | A | * | 2/1998 | Warner et al. | 428/153 |
| 5,786,100 | A | | 7/1998 | Tsuruoka et al. | |
| 5,851,352 | A | * | 12/1998 | Vinson et al. | 162/112 |
| 5,942,588 | A | * | 8/1999 | Ettl et al. | 526/316 |
| 6,086,987 | A | | 7/2000 | Yamanaka et al. | |
| 6,162,329 | A | | 12/2000 | Vinson et al. | |
| 6,514,624 | B2 | * | 2/2003 | Takemoto | 428/447 |
| 6,572,951 | B2 | | 6/2003 | Hasegawa et al. | |
| 6,586,079 | B1 | | 7/2003 | Shibahara et al. | |
| 6,607,637 | B1 | * | 8/2003 | Vinson et al. | 162/204 |
| 6,616,749 | B1 | | 9/2003 | Husband et al. | |
| 6,929,845 | B2 | | 8/2005 | Kai et al. | |
| 7,214,633 | B2 | * | 5/2007 | Sun et al. | 442/59 |
| 2002/0051865 | A1 | | 5/2002 | Hasegawa et al. | |
| 2003/0104237 | A1 | * | 6/2003 | Nakayama et al. | 428/537.5 |
| 2004/0048087 | A1 | * | 3/2004 | Kai et al. | 428/537.5 |
| 2005/0150625 | A1 | * | 7/2005 | Ochi et al. | 162/231 |
| 2007/0113996 | A1 | * | 5/2007 | Ochi et al. | 162/158 |

FOREIGN PATENT DOCUMENTS

| | | | | |
|---|---|---|---|---|
| EP | 0 860 547 | A2 | | 8/1998 |
| EP | 1001082 | A1 | | 5/2000 |
| JP | 57101096 | A | * | 6/1982 |
| JP | 05221175 | A | * | 8/1993 |
| JP | 06-212598 | | | 8/1994 |
| JP | 09-209297 | | | 8/1997 |
| JP | 11-012993 | | | 1/1999 |
| JP | 11-200283 | | | 7/1999 |
| JP | 11-200284 | | | 7/1999 |
| JP | 11-200285 | | | 7/1999 |
| JP | 11-279990 | | | 10/1999 |
| JP | 11-350380 | | | 12/1999 |
| WO | WO 9803730 | A1 | * | 1/1998 |
| WO | WO 0225011 | A1 | | 3/2002 |

* cited by examiner

*Primary Examiner*—José A Fortuna
(74) *Attorney, Agent, or Firm*—Knobbe Martens Olsen & Bear LLP

(57) ABSTRACT

A method of manufacturing a gravure printing paper includes: providing a substance having an effect of inhibiting a binding between pulp fibers; preparing a mixture of pulp fibers and fillers; and adding the substance to the mixture; making a gravure printing paper using the substance-added mixture.

8 Claims, No Drawings

METHOD OF MANUFACTURING GRAVURE PAPER

CROSS-REFERENCE TO RELATED APPLICATIONS

This is a continuation of U.S. patent application Ser. No. 10/381,228, filed Jul. 23, 2003 now abandoned, which is the U.S. National Phase under 35 U.S.C. §371 of International Application PCT/JP2001/08234, filed Sep. 21, 2001, which claims priority to Japanese Patent Application No. 2000-291197, filed Sep. 25, 2000, and No. 2001-255554, filed Aug. 27, 2001. The disclosure of the foregoing applications is herein incorporated by reference in their entirety. The International Application was published under PCT Article 21(2) in a language other than English.

BACKGROUND OF THE INVENTION

1. Field of the Invention

This invention relates to a non-coated gravure printing paper that provides excellent gravure printability through the achievement of better adhesion between the photogravure cylinder and the paper, thereby reducing the generation of speckles.

2. Description of the Related Art

Gravure printing is a type of intaglio printing and therefore it requires a high degree of adhesion between the paper and the photogravure cylinder during printing. Poor adhesion between the paper and photogravure cylinder results in poor transfer of the ink, the likely result of which is the generation of so-called "speckles," or small white spots, particularly in half-tone areas. The speckles invariably reduce the quality of the printed result. Good adhesion is achieved through the high smoothness and cushioning property of the paper. If the paper is smooth, it adheres more closely to the photogravure cylinder. A higher cushioning property allows the paper to deform under pressure during printing and thereby achieve better adhesion to the photogravure cylinder. These effects reduce the occurrence of speckles and thus improve printing quality.

Certain types of pulp and filler—two key ingredients in the production of paper—are selected to achieve higher smoothness and cushioning in a gravure printing paper. As for pulp, the content of mechanical pulp (such as groundwood pulp and refiner groundwood pulp) is maximized to increase the degree of cushioning. If chemical pulp materials must be used, ones having softer fibers are selected. To achieve a smoother surface, normally a gravure paper contains approximately 30% filler. This is more than the level found in offset printing papers, for example, where the filler content is generally 20% or less. Various other agents are added to the pulp and filler mixture, which is then made into paper. The obtained paper then undergoes a process of super-calendering to ensure high smoothness. While a filler consisting of fine, plate-shaped grains improves smoothness, the use of a filler containing grains that are too small in size increases the generation of speckles, although the smoothness does improve. Therefore, the filler content must be limited. Amid increasing environmental awareness throughout the public and industry of late, the use of recycled, ink-removed pulp is now favored over virgin pulp in both mechanical and chemical pulp applications. With chemical pulp it has become difficult to selectively source high-grade wood material from which flexible fibers can be obtained, or to procure chemical pulp made from such high-grade wood material. As a result it has become increasingly important to design quality gravure printing papers that generate less speckling, in addition to seeking the optimal blend of filler and pulp.

SUMMARY OF THE INVENTION

The purpose of this invention is to provide a gravure printing paper that reduces the generation of speckles by achieving better adhesion between the photogravure cylinder and the paper.

The inventors carried out extensive studies to identify ways of reducing speckles on paper during gravure printing, other than methods relating to pulp and filler selection. As a result it was found that speckling decreases when certain organic chemicals are added to the material mixture. This finding has in turn led to the invention presented here. Specifically, this invention provides a gravure printing paper that contains a substance or substances having the effect of inhibiting the binding between pulp fibers.

So-called "surfactant" having a hydrophobic group and a hydrophilic group have the effect of inhibiting the binding between pulp fibers, and therefore such agents (hereinafter referred to as "binding inhibitors") may be used in this invention. However, a binding inhibitor need not be a surfactant as long as it inhibits the binding between fibers. Density reducers (or bulk-increasing agents), developed in recent years for the purpose of increasing paper bulk and currently available in the market, provide a degree of binding inhibition suitable to this invention. For example, higher alcohol containing ethylene and/or propylene oxide, which provides a polyhydric-alcohol type of nonionic surfactant, as defined in WO patent application No. 98/03730; higher fatty acid containing ethylene oxide as defined in Japanese Patent Application Laid-open No. 11-200284; and the ester of the reaction of polyhydric alcohol and fatty acid, ester of the reaction of polyhydric alcohol and fatty acid containing ethylene oxide, and fatty acid polyamide polyamine, as defined in Japanese Patent Application Laid-open No. 11-350380, can all be cited as examples of suitable binding inhibitors. The commercially available bulk-increasing chemicals include Sursol VL by BASF, Bayvolum P Liquid by Bayer, KB-08T, KB-08W, KB-10 and KB-115 by Kao and Reactopaque by Sansho. Two or more of these chemicals may be used in combination.

These binding inhibitors are not known to provide the effect of reducing speckles on gravure printing papers. The reason is not clear, but the following explanation offers a reasonable answer:

The aforementioned bulk-increasing agents or density reducers, when added to the paper material mixture as binding inhibitors, decrease the density of the paper and make the paper bulkier. However, gravure printing papers undergo a super-calendering process to achieve high smoothness, so that the resulting papers have neither higher bulk nor lower density. Nonetheless, because the binding inhibitors partially sever the bindings between pulp fibers and allow the fibers to move freely, when printing pressure is applied on the gravure paper the fibers move in response to the pressure and the paper adheres better to the photogravure cylinder. This facilitates the transfer of ink from the photogravure cylinder, in turn reducing the generation of speckles.

DETAILED DESCRIPTION OF THE PREFERRED EMBODIMENT

This invention is basically a gravure printing paper that contains a substance or substances having the effect of inhibiting the binding between pulp fibers.

The gravure printing paper provided by this invention contains a substance or substances having the effect of inhibiting the binding between pulp fibers, wherein these substances, when added to 0.3 weight % of the bone-dry weight of pulp, will reduce the tensile strength of paper in the machine direction by 5 to 40% as measured per JIS P 8113, compared with the level when no binding inhibitors are added.

The gravure printing paper provided by this invention also contains 5 to 40% of ash as a filler in the aforementioned material composition.

The aforementioned characteristics of the gravure printing paper provided by this invention help achieve greater adhesion between the photogravure cylinder and the paper compared with other papers having similar density and smoothness, because the substance or substances contained in the paper have the effect of inhibiting the binding between pulp fibers. Therefore, the paper so produced provides an excellent benefit of reduced speckling.

The gravure printing paper provided by this invention reduces speckles by adding 0.01 to 10 weight %, or optimally 0.2 to 1.5 weight %, of binding inhibitor relative to the bone-dry weight of the pulp content of the gravure printing paper. If the binding inhibitor content is too high, the binding between fibers is inhibited more than is necessary. This will result in an excessive drop in paper strength, thereby making the paper prone to problems such as tearing. Therefore, a desirable binding inhibitor content is 0.3 weight % of the bone-dry weight of pulp, which should result in a 5 to 40% drop in the tensile strength under the tensile-strength drop test specified in the aforementioned standard.

The gravure printing paper provided by this invention uses chemical pulp (bleached or unbleached kraft pulp from softwood, bleached or unbleached kraft pulp from hardwood, etc.), mechanical pulp (groundwood pulp, thermomechanical pulp, chemi-thermomechanical pulp, etc.), or recycled, ink-removed pulp, wherein these material pulps may be used alone or in combination at arbitrary blending ratios.

The gravure printing paper provided by this invention may have a pH level that is in the acid, neutral or alkali range. It may use known fillers such as kaoline, talc, silica, white carbon, calcium carbonate, titanium oxide and synthetic resin filler. Ideally, fillers should be added to 5 to 40 weight % as the ash content in the paper, with an optimal content being in the range of 10 to 35 weight %. In this range of ash content the invention provides an ideal gravure printing paper offering improved smoothness and gloss. When the ash content exceeds 40 weight %, the paper strength will drop significantly.

Furthermore, the gravure printing paper provided by this invention may contain, if necessary, aluminum sulfate, sizing agent, paper strength enhancer, retention-aiding agent, coloring agent, dye, defoaming agent, and so on.

The gravure printing paper provided by this invention may be coated with surface-treatment agents for the purpose of adding a sizing property and increasing surface strength. The surface-treatment agents that may be used for this purpose are of the water-soluble polymer type. They include: starches such as normal starch, enzyme modified starch, thermochemically modified starch, oxidized starch, esterified starch, etherified starch and cationized starch; polyvinyl alcohols such as normal polyvinyl alcohol, fully saponified polyvinyl alcohol, partially saponified polyvinyl alcohol, carboxyl modified polyvinyl alcohol, silanol modified polyvinyl alcohol, cationic modified polyvinyl alcohol and terminal alkyl modified polyvinyl alcohol; polyacrylic amides such as normal polyacrylic amide, cationic polyacrylic amide, anionic polyacrylic amide and amphoteric polyacrylic amide; and celluloses such as carboxymethyl cellulose, hydroxyethyl cellulose and methyl cellulose. These materials may be used alone or in combination.

The binding inhibitor to be used in this invention may be selected from the substances mentioned earlier, through the use of tests such as the one specified below.

This test uses a pulp slurry of the target paper containing the testing substance by 0.3 weight % of the bone-dry weight of pulp. The mixture is made into paper using an oriented test paper machine (by Kumagaya Riki) operating at a speed of 900 rpm. The resultant paper is pressed and dried in accordance with the methods specified in JIS P 8209 to produce a test paper. In the test conducted by the inventors, a fan dryer was used to dry the paper at 50° C. for one hour. The test paper thus obtained is left in a temperature-controlled environment of 23° C. and a relative humidity of 50% for 24 hours, after which the tensile strength of the paper in the machine direction is measured in accordance with JIS P 8113. Substances that can reduce the tensile strength of paper in the machine direction are deemed suitable as binding inhibitors in this invention.

If the measured drop in tensile strength is very small, it means the applicable substance is less effective in reducing speckles and must be added in relatively greater volume. If the tensile strength drops substantially, just a small amount of that substance can effectively reduce the occurrence of speckling. So, although any substance can be used that reduces the tensile strength of paper, it is preferable to use those that can reduce the tensile strength by around 5 to 40% when added to 0.3 weight %.

The following is a detailed explanation of this invention using examples. However, the invention is not limited to the examples provided.

<Selection of Binding Inhibitor>

A one-% slurry was prepared by combining 30 weight-parts of bleached softwood kraft pulp (NBKP, CSF freeness 550 ml) and 70 weight-parts of refiner groundwood pulp (RGP). Each of the chemicals listed in Table 1 was added to 0.3 weight % of the bone-dry weight of pulp to create a paper material mixture. This paper material mixture was then processed into a paper with a grammage of 60 g/m$^2$ using an oriented test paper machine by Kumagaya Riki operating at a speed of 900 rpm. The paper thus obtained was pressed and dried in accordance with the methods specified in JIS P 8209.

The paper was dried in a fan dryer at 50° C. for one hour to obtain a test paper. The test paper was then left in a temperature-controlled environment of 23° C. and a relative humidity of 50% for 24 hours, after which the tensile strength of the paper in the machine direction was measured in accordance with JIS P 8113.

TABLE 1

| Evaluated chemical | Tensile strength (kN/m) | Drop in tensile strength (%) | Suitability as binding inhibitor |
|---|---|---|---|
| KB-08W (Kao) | 1.53 | 13.7 | ○ |
| KB-110 (Kao) | 1.50 | 14.8 | ○ |
| Sursol VL (BASF) | 1.56 | 9.8 | ○ |
| Bayvolum P Liquid (Bayer) | 1.59 | 9.7 | ○ |
| Reactopaque (Sansho) | 1.63 | 7.4 | ○ |
| Isopropyl alcohol | 1.73 | 1.7 | Δ |
| Starch | 1.85 | −5.1 | X |
| Casein | 1.89 | −7.4 | X |
| Polyethylene glycol | 1.73 | 1.7 | Δ |
| Oleic acid | 1.66 | 5.7 | Δ |

TABLE 1-continued

| Evaluated chemical | Tensile strength (kN/m) | Drop in tensile strength (%) | Suitability as binding inhibitor |
|---|---|---|---|
| Polyacrylic amide | 2.00 | −13.6 | X |
| No substance added | 1.76 | — | |

The above test indicated that the substances that reduce tensile strength by 6% or more are suitable as binding inhibitors in application to this invention, and that those resulting in a strength reduction of 10% or more are particularly suitable.

Next, gravure printing papers were created by adding KB-08W (Kao) and Sursol VL (BASF), these being the two agents that exhibited the best biding inhibition properties among the substances listed in Table 1.

EXAMPLE 1

A paper material mixture was prepared by combining 30 weight-parts of NBKP (CSF freeness 550 ml) and 70 weight-parts of RGP as the pulp content and 30 weight % of Indonesian kaoline as the ash content. KB-08W (by Kao) was added to this mixture as a binding inhibitor to 0.1 weight % of the bone-dry weight of pulp. The material mixture was then processed by an oriented test paper machine (by Kumagaya Riki) into a paper with a grammage of 60 g/m$^2$.

During the paper-making process the pH of the material mixture was adjusted to 4.5 through the addition of aluminum sulfate. The resultant hand-made paper was subsequently processed by a test super-calender to obtain a gravure printing paper with an Oken's smoothness of 1000±100 seconds.

EXAMPLE 2

A gravure printing paper was obtained in the same manner as described in Example 1, except that KB-08W (by Kao) was added as a binding inhibitor to 0.4 weight % of the bone-dry weight of pulp.

EXAMPLE 3

A gravure printing paper was obtained in the same manner as described in Example 1, except that KB-08W (by Kao) was added as a binding inhibitor to 0.8 weight % of the bone-dry weight of pulp.

EXAMPLE 4

A gravure printing paper was obtained in the same manner as described in Example 1, except that Sursol VL (by BASF) was added as a binding inhibitor to 0.8 weight % of the bone-dry weight of pulp.

COMPARATIVE EXAMPLE 1

A gravure printing paper was obtained in the same manner and using super-calendering as described in Example 1, except that no binding inhibitor was added to the material mixture.

EXAMPLE 5

A gravure printing paper was obtained in the same manner and using super-calendering as described in Example 1, except that the material mixture was prepared by combining 20 weight-parts of newspaper DIP, 50 weight-parts of high-grade DIP and 30 weight-parts of RGP as the pulp content and 30 weight % of Indonesian kaoline as the ash content, to which KB-08W (by Kao) was added as a binding inhibitor to 0.8 weight % of the bone-dry weight of pulp.

COMPARATIVE EXAMPLE 2

A gravure printing paper was obtained in the same manner as described in Example 5, except that no binding inhibitor was added to the material mixture.

EXAMPLE 6

A paper material mixture was prepared by combining 30 weight-parts of NBKP (CSF freeness 550 ml) and 70 weight-parts of RGP as the pulp content and 30 weight % of a mixture of Indonesian kaoline and precipitated calcium carbonate blended at a ratio of 5:1 as the ash content. KB-08W (by Kao) was added to this material mixture as a binding inhibitor to 0.8 weight % of the bone-dry weight of pulp, and the mixture was made into a paper with a grammage of 60 g/m$^2$ using an oriented test paper machine. During the paper-making process the pH of the material mixture was adjusted to 7.5 through the addition of aluminum sulfate. The resultant hand-made paper was then processed by a test super-calender to obtain a gravure printing paper.

COMPARATIVE EXAMPLE 3

A gravure printing paper was obtained in the same manner and using super-calendering as described in Example 4, except that no binding inhibitor was added to the material mixture.

The following items were measured on the gravure printing papers obtained in the examples and comparative examples, the results of which are shown in Table 2.

(1) Speckling evaluation: Gravure printing was performed on a two-color gravure printability tester of the type used by the Printing Bureau (by Kumagaya Riki) at a printing speed of 40 m/minute under a printing pressure of 10 kg, and by using OGCT Process (indigo ink) by Toyo Ink (toluene-based, Zahn cup viscosity 10 seconds, 1:6 ratio of toluene to ink), after which the speckles were measured by visually counting the white dots (missing dots) in a 15-% half-tone area (30 mm×34.5 mm).

(2) Density: Measured in accordance with JIS P 8118

(3) Smoothness: Measured using an Oken type smoothness tester (4) Tensile strength: The tensile strength of the paper in the machine direction was measured in accordance with JIS P 8113.

TABLE 2

| | Binding inhibitor content (%) | Density (g/m$^2$) | Smoothness (seconds) | Tensile strength (kN/m) | Speckles |
|---|---|---|---|---|---|
| Example 1 | 0.1 | 0.99 | 950 | 1.28 | 90 |
| Example 2 | 0.4 | 0.99 | 1029 | 1.15 | 53 |
| Example 3 | 0.8 | 0.95 | 916 | 1.03 | 27 |
| Example 4 | 0.8 | 0.97 | 920 | 0.95 | 32 |
| Comparative example 1 | 0 | 0.99 | 935 | 1.35 | 95 |
| Example 5 | 0.8 | 1.00 | 1064 | 0.90 | 8 |
| Comparative example 2 | 0 | 1.01 | 1096 | 1.28 | 22 |

TABLE 2-continued

| | Binding inhibitor content (%) | Density ($g/m^2$) | Smoothness (seconds) | Tensile strength (kN/m) | Speckles |
|---|---|---|---|---|---|
| Example 6 | 0.8 | 0.95 | 1050 | 1.08 | 35 |
| Comparative example 3 | 0 | 0.96 | 980 | 1.42 | 110 |

From the results shown in Table 2, it became clear that the addition of binding inhibitors having the effect of inhibiting the binding between fibers and thereby reducing the tensile strength would reduce the number of speckles generated during gravure printing and therefore improve printing quality. These binding inhibitors, which act upon the bindings between fibers, are sometimes used as density reducers for the purpose of increasing paper bulk. However, gravure printing papers undergo a super-calendering process, and therefore the binding inhibitors do not substantially increase the bulk of such papers. In gravure printing papers the binding inhibitors do not serve as density reducers.

Additionally, although these binding inhibitors tend to increase smoothness during calendering, in the above tests all papers are assumed to have an equivalent smoothness.

The inventors therefore infer that the binding inhibitors reduce the occurrence of speckles on gravure printing papers not because they have density-reducing or smoothness-improving properties but because they allow the fibers to move more freely by inhibiting the binding between them and thus achieve better adhesion between the paper and the photogravure cylinder, thereby reducing the generation of speckles.

When the addition of a binding inhibitor only results in a five-% drop in tensile strength, as in the case of Example 1, speckling is not sufficiently suppressed. When the drop in tensile strength exceeds 10%, as shown by the results of examples 2 through 6, the number of speckles decreases substantially.

Furthermore, the speckle reduction effect of surface-active agents is evident, even after the pH of the paper material mixture is changed from the acid range of pH 4.5 (examples 1 through 5) to the alkali range of pH 7.5 (Example 6). In other words, these agents work effectively in both acid and alkali material mixtures without being affected by pH level.

INDUSTRIAL FIELD OF APPLICATION

This invention allows for the making of a gravure printing paper that provides an excellent benefit of reduced speckling, which is achieved by adding a substance or substances having the effect of inhibiting the binding between pulp fibers in the paper and thereby offering better adhesion between the photogravure cylinder and the paper.

What is claimed is:

1. A method of manufacturing a paper for gravure printing paper, comprising:

selecting a substance having an effect of inhibiting a binding between pulp fibers, based on a criterion of reducing a tensile strength of paper in a machine direction by 5 to 40% as measured when added in amount of 0.3 weight % of a bone-dry weight of pulp included in said paper, compared with the level when no such substance is added;

preparing a mixture of pulp fibers and fillers; and adding the substance to the mixture;

making a paper for gravure printing paper using the substance-added mixture wherein the substance does not serve primarily as a paper density reducer; and wherein the making step comprises super-calendering the paper made from the substance-added mixture.

2. The method according to claim 1, wherein the substance is a bulk-increasing agent or density reducer.

3. The method according to claim 1, wherein the selecting step comprises selecting the substance from the group consisting of a higher alcohol containing ethylene and/or propylene oxide, a polyhydric-alcohol type of nonionic surfactant, a higher fatty acid containing ethylene oxide, an ester of the reaction of polyhydric alcohol and fatty acid, an ester of the reaction of polyhydric alcohol and fatty acid containing ethylene oxide, and fatty acid polyamide polyamine.

4. The method according to claim 1, wherein the preparing step comprises mixing the filler with the pulp fibers in an amount of 5 to 40 weight % as an ash content of the gravure printing paper.

5. The method according to claim 1, wherein the adding step comprises adding the substance in an amount of 0.01 to 10 weight % relative to the bone-dry weight of the pulp fibers.

6. The method according to claim 5, wherein the substance is added in an amount of 0.2 to 1.5 weight % relative to the bone-dry weight of the pulp fibers.

7. The method according to claim 1, wherein the gravure printing paper is non-coated.

8. The method according to claim 1, wherein the paper making step is performed so as to impart the paper to a density of about 1.0 $g/cm^3$.

* * * * *